US010302093B2

(12) United States Patent
Wang et al.

(10) Patent No.: US 10,302,093 B2
(45) Date of Patent: May 28, 2019

(54) SPIRAL FLOW CONSTANT PRESSURE PUMP

(71) Applicant: JOHNSON PRECISION ENGINEERING (SUZHOU) CO., LTD., Suzhou (CN)

(72) Inventors: Qiang Wang, Suzhou (CN); Zhiming Zhang, Suzhou (CN); Cheng Wang, Suzhou (CN)

(73) Assignee: JOHNSON PRECISION ENGINEERING (SUZHOU) CO., LTD., Suzhou (CN)

( * ) Notice: Subject to any disclaimer, the term of this patent is extended or adjusted under 35 U.S.C. 154(b) by 628 days.

(21) Appl. No.: 14/907,810

(22) PCT Filed: Jul. 15, 2014

(86) PCT No.: PCT/CN2014/082216
§ 371 (c)(1),
(2) Date: Jan. 26, 2016

(87) PCT Pub. No.: WO2015/014211
PCT Pub. Date: Feb. 5, 2015

(65) Prior Publication Data

US 2016/0177964 A1 Jun. 23, 2016

(30) Foreign Application Priority Data

Jul. 30, 2013 (CN) ..... 2013 1 0324786

(51) Int. Cl.
*F04D 9/00* (2006.01)
*F04D 29/12* (2006.01)
(Continued)

(52) U.S. Cl.
CPC ..... *F04D 29/126* (2013.01); *F04D 1/00* (2013.01); *F04D 29/043* (2013.01);
(Continued)

(58) Field of Classification Search
USPC ..... 415/58.2
See application file for complete search history.

(56) References Cited

U.S. PATENT DOCUMENTS 4,921,400 A * 5/1990 Niskanen ..... F04D 9/003 415/169.1
5,641,275 A * 6/1997 Klein ..... F04D 29/0413 415/176

(Continued)

FOREIGN PATENT DOCUMENTS

GB 1535678 A * 12/1978 ..... F04D 29/126

*Primary Examiner* — Woody A Lee, Jr.
*Assistant Examiner* — Jason A Fountain
(74) *Attorney, Agent, or Firm* — George G. Wang; Bei & Ocean

(57) ABSTRACT

The Invention provides a spiral flow constant pressure pump, comprising a pump body, a pump casing and an impeller; the pressure drop between the end face of pump rear cover and the rear end face of impeller auxiliary blade is used for providing wash water to sealing device; a hole is opened in the high pressure area of the end face of pump rear cover; the position of the hole for entering the seal cavity is close to the sealing device, leading expectant high pressure water into the seal cavity; a hole is opened in the low pressure area of the end face of pump rear cover; the position of the hole for exiting the seal cavity is far away from the sealing device; the expectant high pressure water that enters the seal cavity will flow back to low pressure area through the drainage hole along flow direction after washing the sealing device; the pump recycles a part of energy, improves the hydraulic efficiency, decreases the turbulent loss and takes way the gas might exist in the seal cavity; the extended orifice sleeve reduces the damage to the pressure drop of the auxiliary blade caused by the high pressure water leaked from seal cavity and thus ensures the balance effect of the auxiliary blade.

6 Claims, 4 Drawing Sheets

(51) Int. Cl.

| | |
|---|---|
| ***F04D 1/00*** | (2006.01) |
| ***F04D 29/10*** | (2006.01) |
| ***F04D 29/043*** | (2006.01) |
| ***F04D 29/22*** | (2006.01) |
| ***F04D 29/42*** | (2006.01) |
| ***F04D 29/24*** | (2006.01) |

(52) U.S. Cl.
CPC ..... *F04D 29/106* (2013.01); *F04D 29/128* (2013.01); *F04D 29/22* (2013.01); *F04D 29/24* (2013.01); *F04D 29/4293* (2013.01)

(56) References Cited

U.S. PATENT DOCUMENTS 5,779,445 A * 7/1998 Yokota ..... F04D 29/126
415/174.2
7,112,033 B1 * 9/2006 Holdorf ..... F04D 29/128
277/360

* cited by examiner

SPIRAL FLOW CONSTANT PRESSURE PUMP

CROSS-REFERENCE TO RELATED APPLICATIONS

This application claims priority from CN Application No. 201310324786.8, filed Jul. 30, 2013 and PCT Application No. PCT/CN2014/082216, filed Jul. 15, 2014, the contents of which are incorporated herein in the entirety by reference.

FIELD OF THE INVENTION

The Invention relates to an improved spiral flow constant pressure pump, belonging to the field of pumps for special field.

BACKGROUND OF THE INVENTION

The most common pump on the market at present often comprises a pump casing, a pump body and an impeller for which a circular-arc front blade is employed. This kind of traditional pump is widely used in many fields for laying more emphasis on energy efficiency, however, the demand for pump lift is higher in some special fields as fire fighting and mining.

The existing patent for the invention titled A Spiral Flow Constant Pressure Pump with the Application No. 200710098031.5 has provided a spiral flow constant pressure pump, comprising a pump casing and an impeller; the inner wall of the pump casing is circular-arc; the impeller comprises a rear cover plate possessing a wheel hub portion, multiple front blades integrated with the rear cover plate and located in the front side thereof, and multiple auxiliary blades integrated with the rear cover plate and located in the rear side thereof; each front blade bends towards anti-clockwise direction near the circular edge of the rear cover plate and slopes towards clockwise direction, forming a bent inclined portion with a certain angle with the front surface of the rear cover plate; the auxiliary blade straightly extends to the external edge of the impeller; when the pump rotates, the outlet centrifugal force of the rear root of the bent inclined portion is greater than that of the front free edge of the bent inclined portion; the flow stream pressure of the rear root is accordingly higher than that of the front free edge; the liquid flows from the rear root to the front free edge, generating longitudinal flow; the rotated flow is generated to form spiral flow as the impeller rotates and then enters the space between the multiple front blades on the impeller for exerting pressure again, the effect of which equals to that of multiple-stage centrifugal pump, thus generating high lift and constant pressure.

However, when the above mentioned spiral flow constant pressure pump runs, the fluid in the seal cavity is not engaged in fluid exchange with the pump body operation chamber; the heat generated by mechanical seal friction cannot be taken away and the temperature of the fluid in the seal cavity will rise for continuous working, bringing hidden danger to the safety during sealed operation. In addition, the seal cavity has no air exhausting device, therefore, when the pump starts to infuse water, the air in the upper part of the seal cavity cannot be exhausted; the air and liquid are actually mixed in the seal cavity when the pump runs and cannot be exhausted, which may damage the mechanical seal.

SUMMARY OF THE INVENTION

The Invention is aimed at providing a spiral flow constant pressure pump, through which, the expectant high pressure water into the seal cavity may wash the sealing device and then flow back to low pressure area through the drainage hole along the flow direction; the pump recycles a part of energy and improves the hydraulic efficiency, addressing the problem of the prior art that the air in the upper part of the seal cavity cannot be exhausted, and the air and liquid are actually mixed in the seal cavity when the pump runs and cannot be exhausted, which may damage the mechanical seal.

The following technical schemes are adopted by the Invention to solve the technical problem:

A spiral flow constant pressure pump, comprising a pump body, a pump casing and an impeller; the pump body is set on the left end of the pump casing; a seal ring is set on the left end of the pump body; a pump shaft and a pump rear cover are set in the pump body; the right end of the pump shaft extends into the pump casing; the impeller is set on the right end of the pump shaft; a shaft sleeve is set outside of the pump shaft; the shaft sleeve is set on the left end of wheel hub; a sealing device is set outside the shaft sleeve; the said pump rear cover is set in the periphery of the sealing device; the pump rear cover and the sealing device form a seal cavity; an inlet inclined hole is opened in the high pressure area on the right end face of the said pump rear cover; the position of the hole for entering the seal cavity is close to the sealing device; an outlet inclined hole is opened in the low pressure area on the right end face of the said pump rear cover; the position of the hole for exiting the seal cavity is far away from the sealing device which functions in a mechanical way.

Preferably, the inner wall of the pump casing is circular-arc; the impeller comprises a rear cover plate possessing a wheel hub portion, multiple front blades integrated with the rear cover plate and located in the front side thereof, and multiple auxiliary blades integrated with the rear cover plate and located in the rear side thereof; each front blade bends towards anti-clockwise direction near the circular edge of the rear cover plate and slopes towards clockwise direction, forming a bent inclined portion with a certain angle with the front surface of the rear cover plate; the auxiliary blade straightly extends to the external edge of the impeller; a pump rear cover is set on the left side of the auxiliary blade.

Preferably, the high pressure area indicates the area that is larger than two-thirds of the corresponding impeller outer diameter of the right end face of pump rear cover; the said low pressure area indicates the area that is smaller than two-thirds of the corresponding impeller outer diameter of the right end face of pump rear cover.

Preferably, the inlet inclined hole is opened at the position that is four-fifths of the corresponding impeller outer diameter of the right end face of pump rear cover; the said outlet inclined hole is opened at the position that is 180° with the inlet inclined hole and a half of the corresponding impeller outer diameter.

Preferably, the mechanical seal functions in combination with the moving shaft and the fixed shaft, wherein, the fixed shaft is set on the right end of the seal ring and the moving shaft is set on the right end of the fixed shaft.

Preferably, an orifice sleeve is set in the said seal cavity; the said orifice sleeve extends to the impeller rear cover plate based on the small gap between pump rear cover and shaft sleeve and impeller hub.

Preferably, the external edge of the bent inclined portion inclines 3° to 10° inwardly from the rear root to the front free edge.

Preferably, the inlet angle of the front blade is 30° to 60°.

Preferably, the outlet angle of the front free edge of the bent inclined portion is 90° to 130°.

Preferably, the outlet angle of the rear root of the bent inclined portion is 110° to 140°.

The beneficial effects of the Invention are as follows: the Invention uses the pressure drop between the end face of pump rear cover and the rear end face of impeller auxiliary blade to provide wash water to sealing device; a hole is opened in the high pressure area of the end face of pump rear cover; the position of the hole entering seal cavity is close to the sealing device, leading expectant high pressure water into the seal cavity; a hole is opened in the low pressure area of the end face of pump rear cover; the position of the hole exiting seal cavity is far away from the sealing device; the expectant high pressure water that enters the seal cavity will flow back to low pressure area through the drainage hole along flow direction; the pump recycles a part of energy, improves the hydraulic efficiency, decreases the turbulent loss and takes way the gas might exist in the seal cavity; the extended orifice sleeve reduces the damage to the pressure drop of the auxiliary blade caused by the high pressure water leaked from seal cavity and thus ensures the balance effect of the auxiliary blade.

Figure 1:
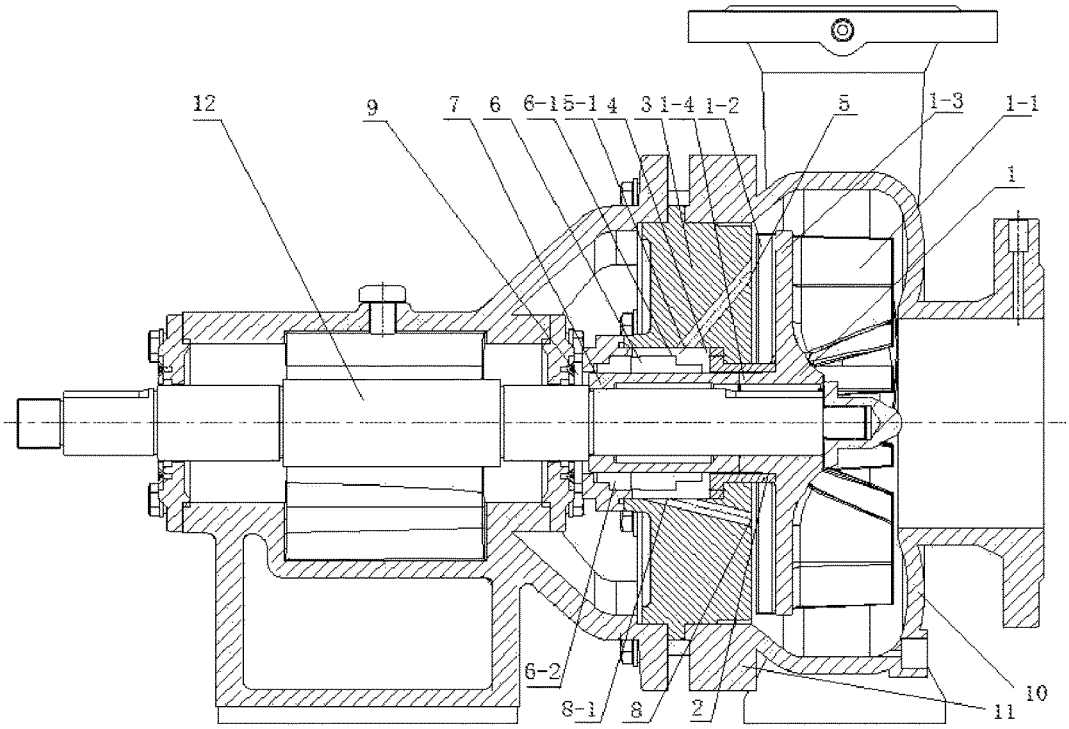
FIG. 1 is a structural diagram of the embodiments thereof.
Figure 2:
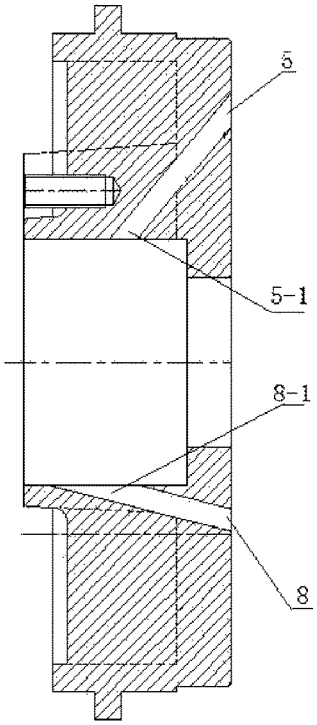
FIG. 2 is an elevation profile diagram of the pump rear cover.
Figure 3:
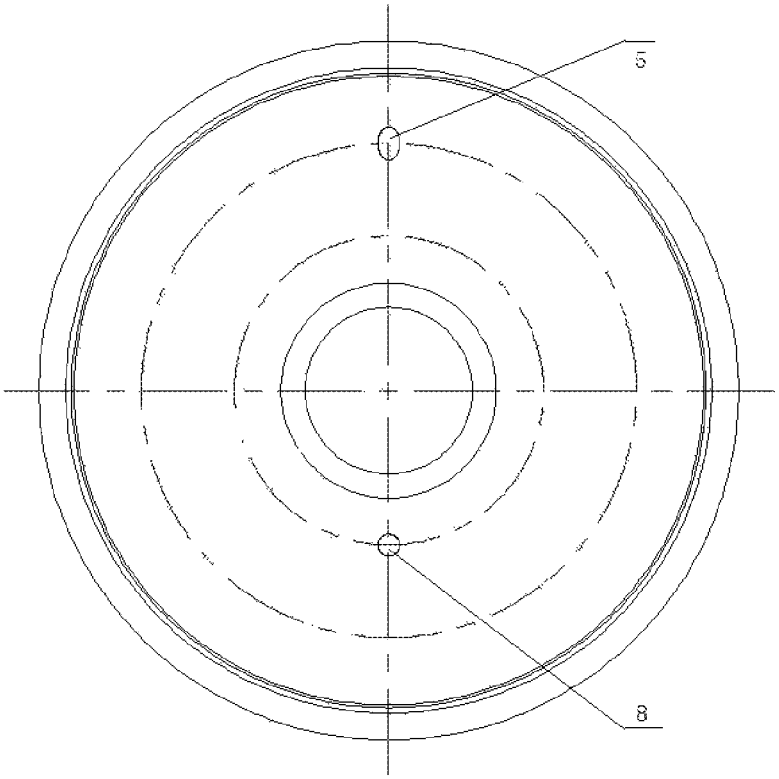
FIG. 3 is a schematic diagram of the end face of the pump rear cover.
Figure 4:
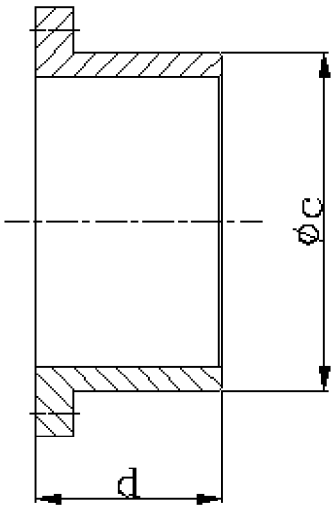
FIG. 4 is a schematic diagram of the orifice sleeve.

Wherein: 1, impeller; 1-1, front blade; 1-2, auxiliary blade; 1-3, rear cover plate; 1-4, wheel hub; 2, orifice sleeve; 3, pump rear cover; 4, seal cavity; 5, inlet inclined hole; 5-1, position of the inlet inclined hole entering seal cavity; 6, sealing device; 6-1, moving shaft; 6-2; fixed shaft; 7, shaft sleeve; 8, outlet inclined hole; 8-1; position of the outlet inclined hole exiting seal cavity; 9, seal ring; 10, pump casing; 11, pump body; 12, pump shaft.

DETAILED DESCRIPTION OF PARTICULAR EMBODIMENTS OF THE INVENTION

The embodiments of the Invention are described in details as follows. The examples of the embodiments are shown in Drawings, wherein, the never-changed identical or similar mark numbers indicate the identical or similar elements or the elements with identical or similar functions. The embodiments described below based on reference drawings are examples for explaining the Invention only, but cannot be interpreted as a limit to the utility model.

As shown is FIGS. 1 to 4, a spiral flow constant pressure pump, comprising a pump body 11, a pump casing 10 and an impeller 1; the inner wall of the said pump casing 10 is circular-arc; the impeller 1 comprises a rear cover plate 1-3 possessing a wheel hub 1-4 portion, multiple front blades 1-1 integrated with the rear cover plate 1-3 and located in the front side thereof, and multiple auxiliary blades 1-2 integrated with the rear cover plate 1-3 and located in the rear side thereof; the auxiliary blade 1-2 straightly extends to the external edge of the impeller 1; each front blade 1-1 bends towards anti-clockwise direction near the circular edge of the rear cover plate 1-3 and slopes towards clockwise direction, forming a bent inclined portion with a certain angle with the front surface of the rear cover plate 1-3; the external edge of the bent inclined portion inclines 3° to 10° inwardly from the rear root to the front free edge, preferably 6°; the inlet angle of the front blade is 30° to 60°, preferably 45°; the outlet angle of the front free edge of the bent inclined portion is 90° to 130°, preferably 100°; the outlet angle of the rear root of the bent inclined portion is 110° to 140°, preferably 130°.

The pump body 11 is set on the left end of the pump casing 10; a seal ring 9 is set on the left end of the pump body 11; a pump shaft 12 and a pump rear cover 3 are set in the pump body 11; the right end of the pump shaft 12 extends into the pump casing 10; the impeller 1 is set on the right end of the pump shaft 12; a shaft sleeve 7 is set outside of the pump shaft 12; the shaft sleeve 7 is set on the left end of wheel hub 1-4; a sealing device 6 is set outside of the shaft sleeve 7; the pump rear cover 3 is set on the left side of auxiliary blade 1-2 and in the periphery of the sealing device 6; the pump rear cover 3 and the sealing device 6 form a seal cavity 4; an inlet inclined hole 5 is opened at the distance of four-fifths from the outer diameter of impeller 1 on the right end face of the pump rear cover 3; the position of the hole for entering the seal cavity 5-1 is close to the sealing device 6; an outlet inclined hole 8 is opened on the position with 180° of the inlet inclined hole at the distance of a half from the outer diameter of impeller 1; the position of the hole for exiting the seal cavity 4 is far away from the sealing device 6 which functions in a mechanical way, comprising fixed shaft 6-2 and moving shaft 6-1; fixed shaft 6-2 is set on the right end of the seal ring 9 and moving shaft 6-1 is set on the right end of the fixed shaft 6-2; when the constant pressure pump runs, fixed shaft 6-2 holds still, while moving shaft 6-1 rotates along with pump shaft 12.

An orifice sleeve 2 is set in the seal cavity 4; the orifice sleeve 2 extends to the impeller rear cover plate 1-3 based on the small gap between pump rear cover 3 and shaft sleeve 7 and impeller hub 2.

The inner wall of the pump casing 10 may be circular-arc; preferably, the inner wall of the pump casing 10 forms multi-circular-arc one. Specifically, the inner wall of multi-circular-arc pump casing 10 comprises a front circular arc portion with a radius of R1, a middle circular arc portion with a radius of R2 and a rear inclined linear portion that slopes to the center line of pump casing 10 from front to rear; the front circular arc portion with a radius of R1, the middle circular arc portion with a radius of R2 and the rear inclined linear portion that slopes to the center line of pump casing 10 from front to rear rotate one circle around the center line of pump casing to form a inner wall of the pump casing; the radius R1 is greater than radius R2, thus the multi-circular-arc inner wall is formed, which may lead impeller 1 and front blade 1-1 to form a spiral flow in the pump to enter the space between impeller 1 and front blade 1-1 repeatedly, thus the outlet pressure of the pump is further increased. For the multi-circular-arc inner wall of pump casing 10, please refer to the Chinese patent document with the Publication Patent Number of CN101294580 B.

When the constant pressure pump rotates, the outlet centrifugal force of the rear root of the bent inclined portion is greater than that of the front free edge of the bent inclined portion; the flow stream pressure of the rear root is accordingly higher than that of the front free edge; the liquid flows from the rear root to the front free edge, generating longitudinal flow; the rotated flow is generated to form spiral flow as the impeller rotates and then enters the space between the multiple front blades 1-1 on the impeller 1 for exerting pressure again; the effect of which equals to that of multiple-stage centrifugal pump and thus the high lift and constant pressure are obtained; it may be widely used in the fields as fire fighting and mining.

Meanwhile, the embodiment uses the pressure drop between the end face of pump rear cover 3 and the rear end face of impeller auxiliary blade 1-2 to provide wash water to sealing device 6; a hole 5 is opened in the high pressure area of the end face of pump rear cover 3; the position of the hole entering seal cavity 5-1 is close to the sealing device 6, leading expectant high pressure water into the seal cavity 4; a hole 8 is opened in the low pressure area of the end face of pump rear cover; the position of the hole exiting seal cavity 8-1 is far away from the sealing device 6; the expectant high pressure water that enters the seal cavity 4 will flow back to low pressure area through the drainage hole 8 along flow direction after washing the sealing device 6; the pump recycles a part of energy, improves the hydraulic efficiency, decreases the turbulent loss and takes way the gas might exist in the seal cavity; the extended orifice sleeve 2 reduces the damage to the pressure drop of the auxiliary blade 1-2 caused by the high pressure water leaked from seal cavity 4 and thus ensures the balance effect of the auxiliary blade 1-2.

Embodiment 1

Figure 5:
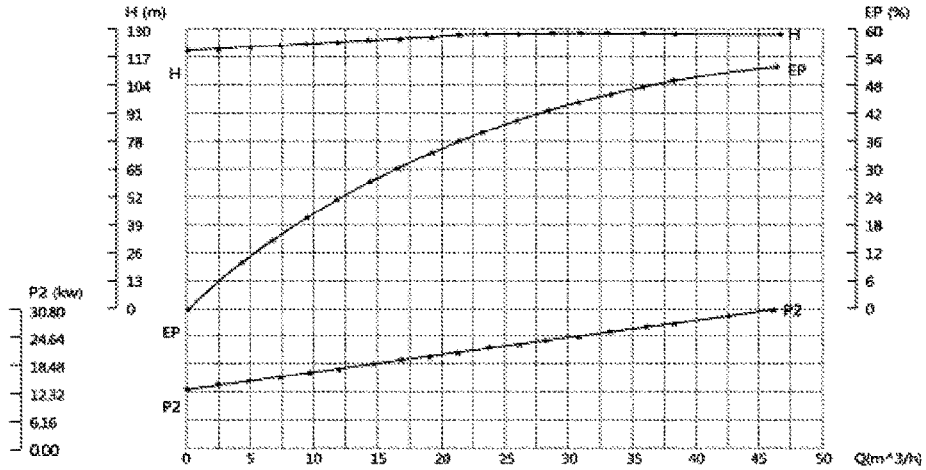
FIG. 5 is a performance curve diagram of Embodiment 1 thereof.

In Embodiment 1, the spiral flow constant pressure pump provided by the Invention is applied in the field of mobile fire fighting; the performance curve is as shown in FIG. 5. The most common mobile fire fighting unit on the market is that of Jicai 12V190 series. In the embodiment, the lift standard of the spiral flow constant pressure pump of the Invention is set in accordance with that of Jicai 12V190 for testing and comparing, the parameter comparison of Embodiment 1 and fire fighting unit of Jicai 12V190 series is shown as follows:

| Model | Power Pa (HP) | Lift H (m) | Flow Q ($m^3$/h) | Mass (Kg) |
|---|---|---|---|---|
| Jicai 12V190 | 50 | 130 | 42 | 121 |
| Embodiment 1 | 27 | 130 | 40 | 55 |
| Jicai 12V190 | 10 | 50 | 30 | 30 |
| Embodiment 1 | 7 | 52 | 18 | 24 |

It is thus clear from the above table that, compared with the mobile fire fighting unit on the market, Embodiment 1 has a smaller power and flow at the same lift, which not only saves energy, but also has a mass lighter than that of the mobile fire fighting unit on the market by more than a half, thus significantly improving the portability.

Embodiment 2

Figure 6:
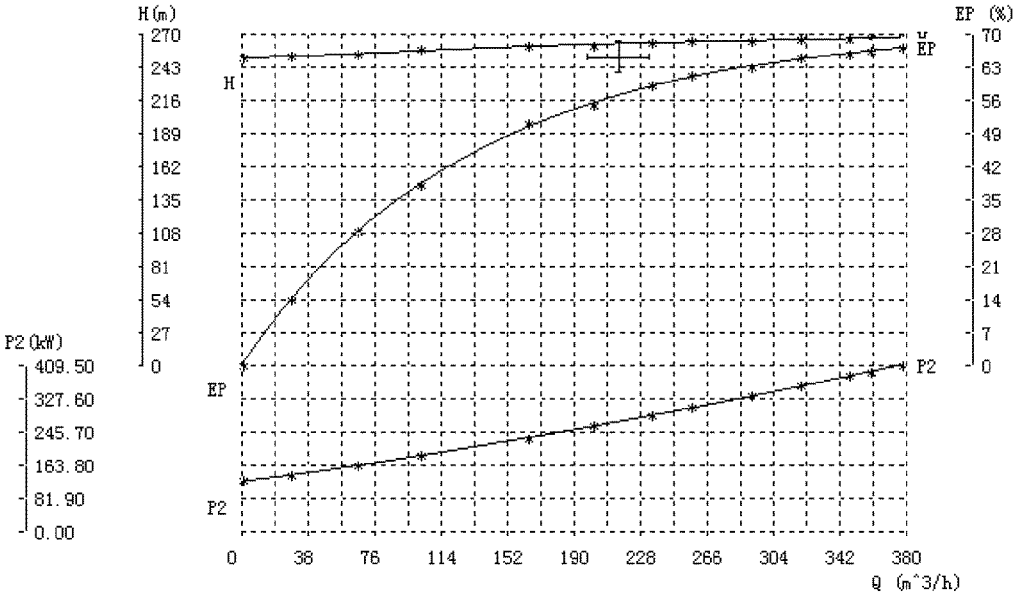
FIG. 6 is a performance curve diagram of Embodiment 2 thereof.

In Embodiment 2, the spiral flow constant pressure pump provided by the Invention is applied in the field of mining; the performance curve is as shown in FIG. 6. The most common mine pump on the market is MD280-43X6 multistage pump. In the embodiment, the lift standard of the spiral flow constant pressure pump of the Invention is set in accordance with that of MD280-43X6 multistage pump for testing and comparing, the parameter comparison of Embodiment 2 and MD280-43X6 multistage pump is shown as follows:

| Model | Power Pa (HP) | Lift H (m) | Flow Q ($m^3$/h) | Mass (Kg) |
|---|---|---|---|---|
| MD280-43X6 | 315 | 228-282 | 335-185 | 1147 |
| Embodiment 2 | 275 | 258 | 0-335 | 240 |

It is thus clear from the above table that the lift of the existing MD280-43X6 multistage pump decreases with the increase of the flow; while the lift of Embodiment 2 barely changes within the scope of full flow; in addition, the mass of Embodiment 2 is less than a quarter of that of MD280-43X6 multistage pump, more convenient for transportation.

Embodiment 3

Figure 7:
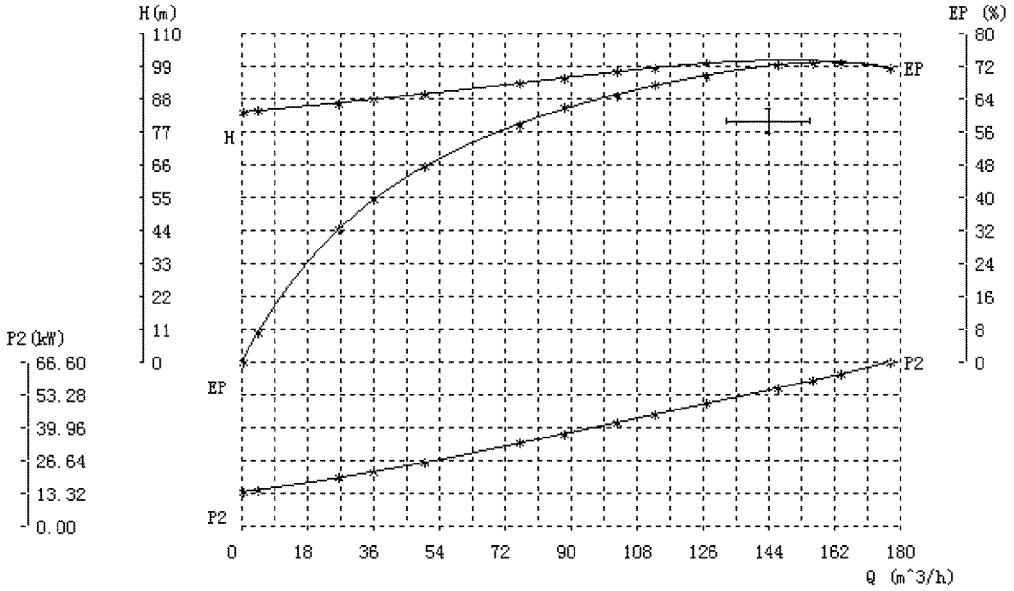
FIG. 7 is a performance curve diagram of Embodiment 3 thereof.

In Embodiment 3, the spiral flow constant pressure pump provided by the Invention is applied in the field of building fire-fighting; the performance curve is as shown in FIG. 7. The most common building fire pump on the market is XBD12/80 fire pump. In the embodiment, the lift standard of the spiral flow constant pressure pump of the Invention is set in accordance with that of XBD12/80 fire pump for testing and comparing, the parameter comparison of Embodiment 3 and XBD12/80 fire pump is shown as follows:

| Model | Power Pa (HP) | Lift H (m) | Flow Q ($m^3$/h) | Mass (Kg) | Pressure Stabilizing System |
|---|---|---|---|---|---|
| XBD12/80 | 75 | 102 | 90 | 250 | YES |
| Embodiment 3 | 75 | 100 | 144 | 120 | NO |

The existing XBD12/80 fire pump must be equipped with variable frequency and speed system so that it can pump water at constant pressure; the variable frequency and speed system is a electronic equipment with short life, high energy consumption and poor stability, the cost of which is three time of that of pump itself; thus the reliability and cost of XBD12/80 fire pump cannot be guaranteed; while Embodiment 3 can realize constant pressure by itself without variable frequency and speed system, possessing the characteristics as low cost, small size, low energy consumption and high reliability.

Embodiment 4

Figure 8:
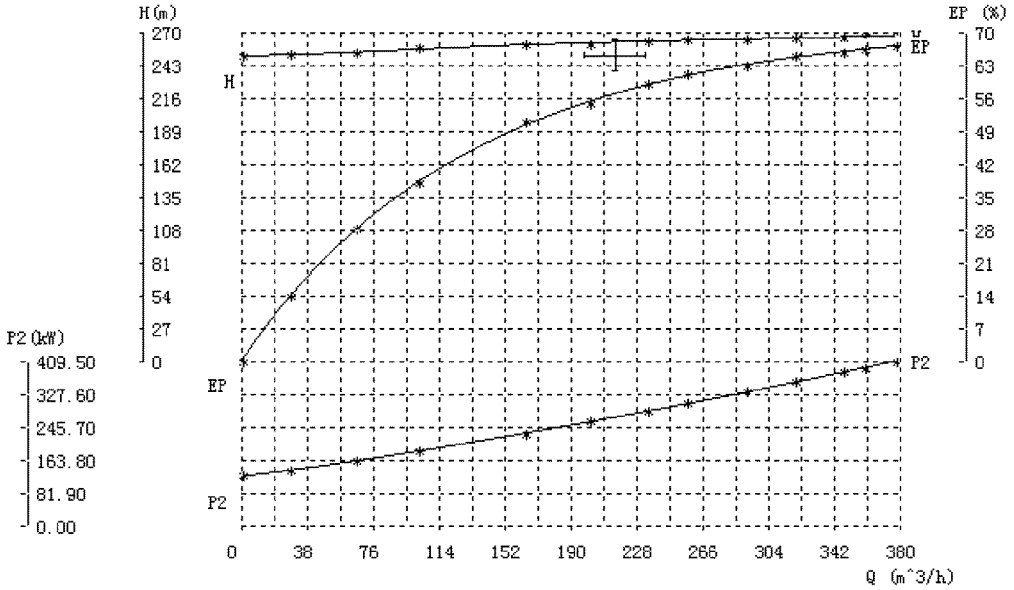
FIG. 8 is a performance curve diagram of Embodiment 4 thereof.

In Embodiment 4, the spiral flow constant pressure pump provided by the Invention is applied to vehicle-mounted fire facilities; the performance curve is as shown in FIG. 8. The most common vehicle-mounted fire fighting unit on the market is Waterous unit of America. In the embodiment, the lift standard of the spiral flow constant pressure pump of the Invention is set in accordance with that of Waterous unit for testing and comparing, the parameter comparison of Embodiment 4 and Waterous unit is shown as follows:

| Model | Power Pa (HP) | Lift H (m) | Flow Q ($m^3$/h) | Mass (Kg) |
|---|---|---|---|---|
| Waterous | 350 | 100-400 | 226-79 | 500 |
| Embodiment 4 | 275 | 258 | 0-226 | 240 |

It is thus clear from the above table that the lift of the existing Waterous unit decreases obviously with the increase of the flow; while the lift of Embodiment 4 barely changes within the scope of full flow; in addition, the mass of Embodiment 4 is less than a half of that of Waterous unit, which is more convenient for transportation.

In addition, in the above embodiments, the spiral flow constant pressure pump provided by the Invention possesses self-cooling function, which reduces the probability of being over heat for the machine, thus the service life of the machine is prolonged.

In the Description, the terms as "an embodiment", "some embodiments", "example", "specific example" or "some examples" indicate that the particular characteristics, structures, materials or features described in combination with the embodiment or example are included in at least one embodiment or example of the utility model. In the Description, the schematic expressions for the above terms do not necessarily mean the same embodiments or examples. Moreover, the described particular characteristics, structures, materials or features may be combined in a proper way in any one or several embodiments or examples.

Although, the embodiments of the Invention have been shown and described, it can be understood by a person skilled in the art that these embodiments may be changed, amended, replaced and deformed under the premise of not departing from the principle and purpose of the utility model; the scope of the Invention is limited by the Claims and the equivalents.

What is claimed is:

1. A spiral flow constant pressure pump, comprising a pump body having a high pressure area and a low pressure area, a pump casing and an impeller; wherein a pump shaft with a first end and second end and a pump rear cover are set in the pump body; the first end of the pump shaft extends into the pump casing and is connected to the impeller; a shaft sleeve is set over the pump shaft; a sealing device is set over the shaft sleeve; the pump rear cover and the sealing device defines a seal cavity; and inside the pump rear cover, an inlet passage and an outlet passage are provided with the inlet passage connecting the high pressure area to the seal cavity and the outlet passage connecting the seal cavity to the low pressure area.

2. The spiral flow constant pressure pump according to claim 1, wherein the pump casing has an inner wall of a circular-arc contour; the impeller comprises a rear cover plate integrated with a wheel hub, multiple front blades in the front side thereof, and multiple auxiliary blades in the rear side thereof.

3. The spiral flow constant pressure pump according to claim 2, wherein, the pump rear cover and the rear cover plate of the impeller define a gap of a generally cylindrical shape with a diameter and the gap is separate from the seal cavity and comprises the high pressure area and the low pressure area; the low pressure area lies two-thirds of the diameter towards the center of the cylindrical gap while the high pressure area lies one-third of the diameter towards the peripheral of the cylindrical gap.

4. The spiral flow constant pressure pump according to claim 3, wherein the inlet passage opens at a position that is four-fifths of the diameter from the center of the cylindrical gap; the outlet passage opens at a position that is at one half of the diameter; and the inlet passage and the outlet passage are on opposite sides of the diameter.

5. The spiral flow constant pressure pump according to claim 1, wherein the sealing device is a mechanical seal which is a combination of a movable shaft (6-1) and a fixed shaft (6-2).

6. The spiral flow constant pressure pump according to claim 1, further comprising an orifice sleeve (2) extending from the seal cavity to the cylindrical gap.

* * * * *